US010084269B2

(12) United States Patent
Cornelius et al.

(10) Patent No.: US 10,084,269 B2
(45) Date of Patent: Sep. 25, 2018

(54) VARIATIONS IN USB-C CONTACT LENGTH TO IMPROVE DISCONNECT SEQUENCE

(71) Applicant: Apple Inc., Cupertino, CA (US)

(72) Inventors: William P. Cornelius, Saratoga, CA (US); Mahmoud R. Amini, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/223,486

(22) Filed: Jul. 29, 2016

(65) Prior Publication Data

US 2017/0033518 A1 Feb. 2, 2017

Related U.S. Application Data

(60) Provisional application No. 62/199,225, filed on Jul. 30, 2015.

(51) Int. Cl.

| | |
|---|---|
| ***H01R 24/00*** | (2011.01) |
| ***H01R 33/00*** | (2006.01) |
| ***H01R 24/60*** | (2011.01) |
| ***H01R 13/6471*** | (2011.01) |
| ***H01R 13/648*** | (2006.01) |

(52) U.S. Cl.

CPC ..... *H01R 24/60* (2013.01); *H01R 13/6471* (2013.01); *H01R 13/6485* (2013.01)

(58) Field of Classification Search

CPC ..... H01R 23/02; H01R 24/60; H01R 12/75; H05K 2201/09709; Y10S 439/9241

USPC ..... 439/660, 924.1, 60

See application file for complete search history.

(56) References Cited

U.S. PATENT DOCUMENTS

| | | | | |
|---|---|---|---|---|
| 9,590,364 | B1 * | 3/2017 | Chang | H01R 13/6581 |
| 2013/0005193 | A1 * | 1/2013 | Tsai | H01R 13/6315 439/676 |
| 2013/0065448 | A1 * | 3/2013 | Chiu | H01R 13/6658 439/660 |
| 2014/0287626 | A1 * | 9/2014 | Lin | H01R 31/06 439/607.56 |
| 2015/0024612 | A1 * | 1/2015 | Little | H01R 13/6658 439/55 |
| 2015/0147915 | A1 * | 5/2015 | Taniguchi | H01R 13/6461 439/660 |
| 2015/0340791 | A1 * | 11/2015 | Kao | H01R 24/60 439/676 |
| 2015/0349465 | A1 * | 12/2015 | Cornelius | H01R 13/6469 439/620.22 |
| 2017/0085036 | A1 * | 3/2017 | Tsai | H01R 24/60 |
| 2017/0237202 | A1 * | 8/2017 | Gao | H01R 13/6582 439/345 |
| 2017/0346238 | A1 * | 11/2017 | Ju | H01R 13/6583 |

* cited by examiner

*Primary Examiner* — Abdullah Riyami
*Assistant Examiner* — Thang Nguyen
(74) *Attorney, Agent, or Firm* — Kilpatrick Townsend & Stockton, LLP

(57) ABSTRACT

Connector receptacle tongues having contacts arranged to disconnect from corresponding contacts in a connector insert in such a way that undesirable current pathways that damage electrical components associated with the connector receptacle are avoided. Other examples include connector receptacles having a tongue in a passage and ground spring contacts located in openings in sides of the passage, where the ground spring contacts connect to a shield of a connector insert such that these undesirable current pathways are avoided.

20 Claims, 8 Drawing Sheets

VARIATIONS IN USB-C CONTACT LENGTH TO IMPROVE DISCONNECT SEQUENCE

CROSS REFERENCE TO RELATED APPLICATIONS

This application claims the benefit of U.S. provisional patent application No. 62/199,225, filed Jul. 30, 2015, which is incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices.

Power may be transferred with this data, or power may be transferred separately. Power and data may be conveyed over cable assemblies. Cable assemblies may include a cable that may have wire conductors, fiber optic cables, or some combination of these or other conductors. Cable assemblies may also include a connector insert at each end of the cable, though other cable assemblies may be connected or tethered to an electronic device in a dedicated manner. The connector inserts of the cable assemblies may be inserted into receptacles in the communicating electronic devices to form power and data pathways between them.

On occasion, a connector insert may be removed from an electronic device while power and signal voltages are being applied through the cable assembly. As the connector insert is removed, contacts and other grounding structures in the connector insert may come into electrical contact with various contacts and structures in the corresponding connector receptacle. These transient electrical connections may form undesirable current pathways that may damage input electrical components associated with the connector receptacle and housed in the electronic device.

Thus, what is needed are connector receptacle tongues having contacts arranged to disconnect from corresponding contacts in a connector insert in such a way that these undesirable current pathways that may damage electrical components connected to the connector receptacle are avoided.

SUMMARY

Accordingly, embodiments of the present invention may provide connector receptacle tongues having contacts arranged to disconnect from corresponding contacts in a connector insert in such a way that undesirable current pathways that may damage electrical components connected to the connector receptacle are avoided.

In a conventional Universal Serial Bus type-C connector (USB-C) connector receptacle, bus voltage (VBUS) power contacts and ground contacts are placed the same distance from the front of a connector receptacle tongue such that they simultaneously disconnect from corresponding contacts in a connector insert when the connector insert is removed from the connector receptacle. But there may be variations associated with the lengths and placement of the VBUS power and ground contacts in the connector receptacle and connector insert. This may result in VBUS power being applied to the electronic device after ground has been disconnected as the connector insert is removed. At the same time, a signal pin on the receptacle tongue may become grounded when an electromagnetic-interference (EMI) contact on the connector insert electrically connects to the signal contact during extraction of the connector insert. When this occurs after the electronic device was being charged, current may flow from the VBUS power supply, through an electrostatic-discharge (ESD) diode that is integrated on an integrated circuit connected to the connector receptacle, and out through the grounded signal pin. This current may damage the integrated ESD diode or related components, or both, and therefore may damage the integrated circuit.

An illustrative embodiment of the present invention may avoid damage to the ESD diode and related components by shortening VBUS power contacts on a USB-C connector receptacle tongue. In one specific embodiment of the present invention, the lengths of one or more VBUS power contacts are decreased to the same length as that of a signal contact. Specifically, ends of the VBUS power contacts are pulled back from a front edge of the connector receptacle tongue until they are aligned with ends of the signal contacts. This modified arrangement may prevent power from being applied to an integrated circuit connected to the connector receptacle while the integrated circuit ground is floating.

In this modified configuration, there may be other variations associated with the lengths of the VBUS power and signal contacts in the connector receptacle and connector insert. During a connector insert extraction, this may lead to a transient condition where VBUS power has been removed while a high voltage remains applied to a signal contact on the receptacle tongue. Specifically, a signal contact may receive a high voltage, and the signal contact may be closer to a front edge of the connector receptacle tongue than the VBUS power contacts. An input integrated circuit connected to the receptacle tongue may thus have its power removed while a high voltage is received at an input structure. This could damage the input structure, depending on the specific design of that input. Embodiments of the present invention may provide an increased capacitance on the VBUS power line in order to power the input component during a disconnect after the VBUS power is removed. These or other embodiments of the present invention may provide an input structure that is tolerance to a high input voltage on a signal pin in the absence of VBUS power. These or other embodiments of the present invention may alternating current (AC) couple signal pins through capacitors in order to avoid direct current DC voltages from being applied directly to signal contacts.

Another illustrative embodiment of the present invention may avoid damage to an ESD diode and related components by partially pulling a front edge of the VBUS power contacts away from a front edge of a receptacle tongue, such that the VBUS power contacts have a length that is between the length of the ground contacts and the signal contacts on the connector receptacle tongue. Specifically, the VBUS contacts on the USB-C tongue may be pulled back from a front edge of the tongue such that ends of the ground contacts are closest to the front, followed by the VBUS contacts, and where ends of the signal contacts are furthest from the front edge. In these and other embodiments of the present invention, the ground contacts may be moved forward toward the front of the tongue to decrease the possibility that a VBUS power path remains connected after the ground contacts have been disconnected. For example, one or more ground contacts may be extended such that they reach the front of the tongue. When the ground contacts are extended forward, care should be taken that a protective covering layer or solder mask between the ground contact and front edge of the receptacle tongue does not become so narrow that it is removed or damaged by the friction of the ground contacts following several insertions and extractions. In some embodiments of the present invention, the protective covering layer or solder mask between the ground contact and front edge of the receptacle tongue may be omitted for this reason, though this may increase the wear on the ground contacts of the connector inset and damage any conductive plating used on them.

Again, there may be variations associated with the lengths of the power and ground contacts in the connector receptacle and connector insert. These variations are expected and anticipated by the USB-C specification that dictates a range of lengths having specific tolerances for compliant contacts. These tolerances may be larger than needed for a given connector receptacle manufacturing process. Accordingly, another illustrative embodiment of the present invention may provide a connector receptacle where targets for contact lengths may be shifted from near a center of a specification range to lengths and positions that may help to decrease the possibility that a VBUS power path remains connected after the ground contacts have been disconnected. In one specific embodiment, ground contacts may be lengthened while VBUS power contacts are shortened. More specifically, an edge of the VBUS power contacts may be pulled back from a front edge of the tongue while edges of the ground contacts may be moved forward toward the front edge. The lengths of the contacts may remain within the USB-C specification and the possibility that a VBUS power path remains connected after the ground contacts have been disconnected may be reduced. In these and other embodiments of the present invention, the signal contacts may be shortened as well to decrease the possibility of that a signal voltage may remain applied to an input electrical device after VBUS has been removed. That is, an edge of the signal contacts may be pulled back from a front edge of the tongue to decrease the possibility of that a signal voltage may remain applied to an input electrical device after VBUS has been removed.

In these and other embodiments of the present invention, a connector insert may include a shield, while the connector receptacle may not have a corresponding shield. Accordingly, another illustrative embodiment of the present invention may provide a connector receptacle having ground contacts to form ground paths through a connector insert shield. These ground contacts may be arranged as springs or other flexible contacts to form electrical connections with a connector insert shield. This may help to ensure that a ground path remains connected until the VBUS power contact on the connector receptacle tongue disconnects from its corresponding contact in the connector insert. The ground contacts may be formed of sheet metal, spring steel, flexible gaskets, or other any elastic conducive material.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
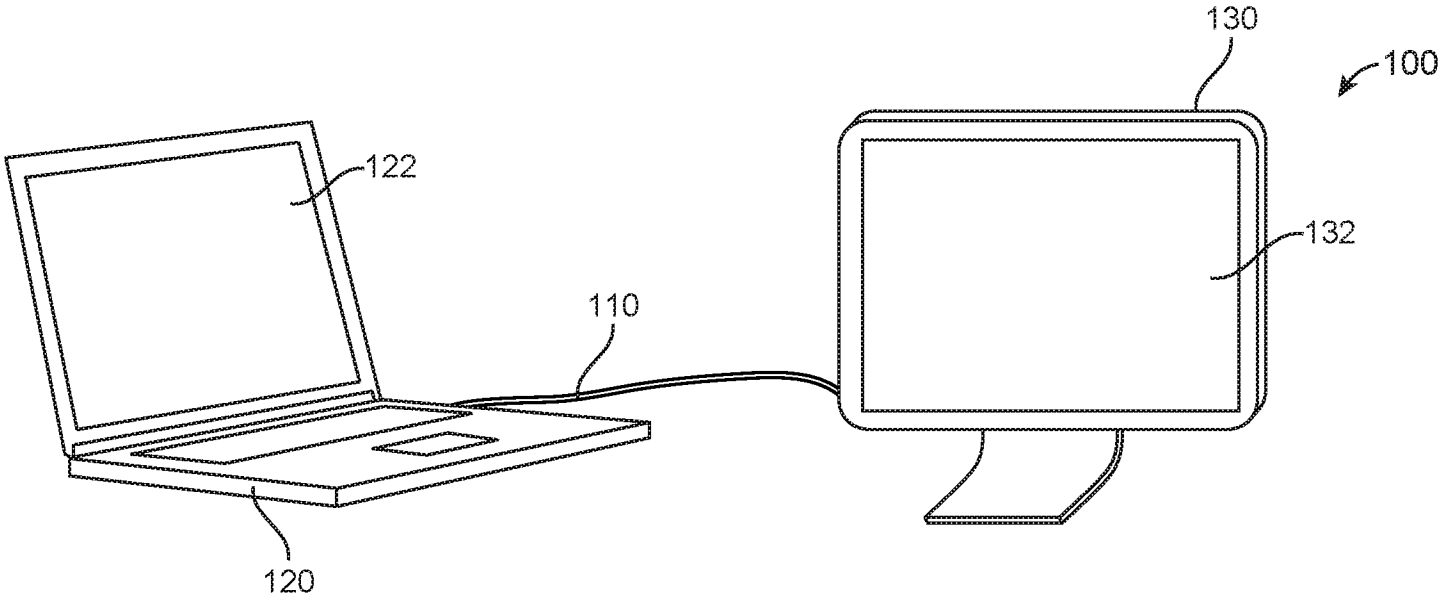
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

Electronic system 100 may include cable 110 joining electronic devices 120 and 130. In this example, electronic device 120 may be a laptop or portable computer having screen 122. Electronic device 130 may be a monitor 130 that may include screen 132. In other embodiments of the present invention, cable 110 may couple various types of devices, such as portable computing devices, tablets, desktop computers, all-in-one computers, cell phones, smart phones, media phones, storage devices, portable media players, navigation systems, monitors power supplies, adapters, and chargers, and other devices. These cables, such as cable 110, may provide pathways for signals and power compliant with USB Type-C interfaces. Cable 110 may attach to electronic devices 120 and 130 through connector receptacles provided by embodiments of the present invention.

Again, in a conventional Universal Serial Bus type-C connector (USB-C) connector receptacle, VBUS power contacts and ground contacts may be positioned to have ends that may be the same distance from the front of a connector receptacle tongue such that they simultaneously disconnect from corresponding contacts in a connector insert when the connector insert is extracted from the connector receptacle. But there may be variations associated with the lengths and placement of the VBUS power and ground contacts in the connector receptacle and connector insert. More specifically, there may be variations in the position of an end of a contact relative to a front of a connector insert or connector receptacle tongue. These variations may result in VBUS power being applied to the electronic device after ground has been disconnected as the connector insert is removed. Specifically, an end of a VBUS power contact may be longer than an end of the ground contacts on a tongue. This may mean that as the connector insert is removed while an electronic device housing the connector receptacle is being charged, power may be applied to a VBUS power contact on the tongue in the absence of a ground connection to the ground contacts on the tongue. Similarly, the lengths or positions of contacts in the connector insert may be skewed to achieve the same effect. If this happens when an EMI ground contact engages a signal contact, a large current may flow from the VBUS power supply and VBUS power contact, through an ESD diode that is integrated on an integrated circuit connected to the connector receptacle, and out through the grounded signal pin. This current may damage the integrated ESD diode or related components, or both, and therefore may damage the electrical component. An example of how this electrical configuration may occur is shown in the following figure.

Figure 2:
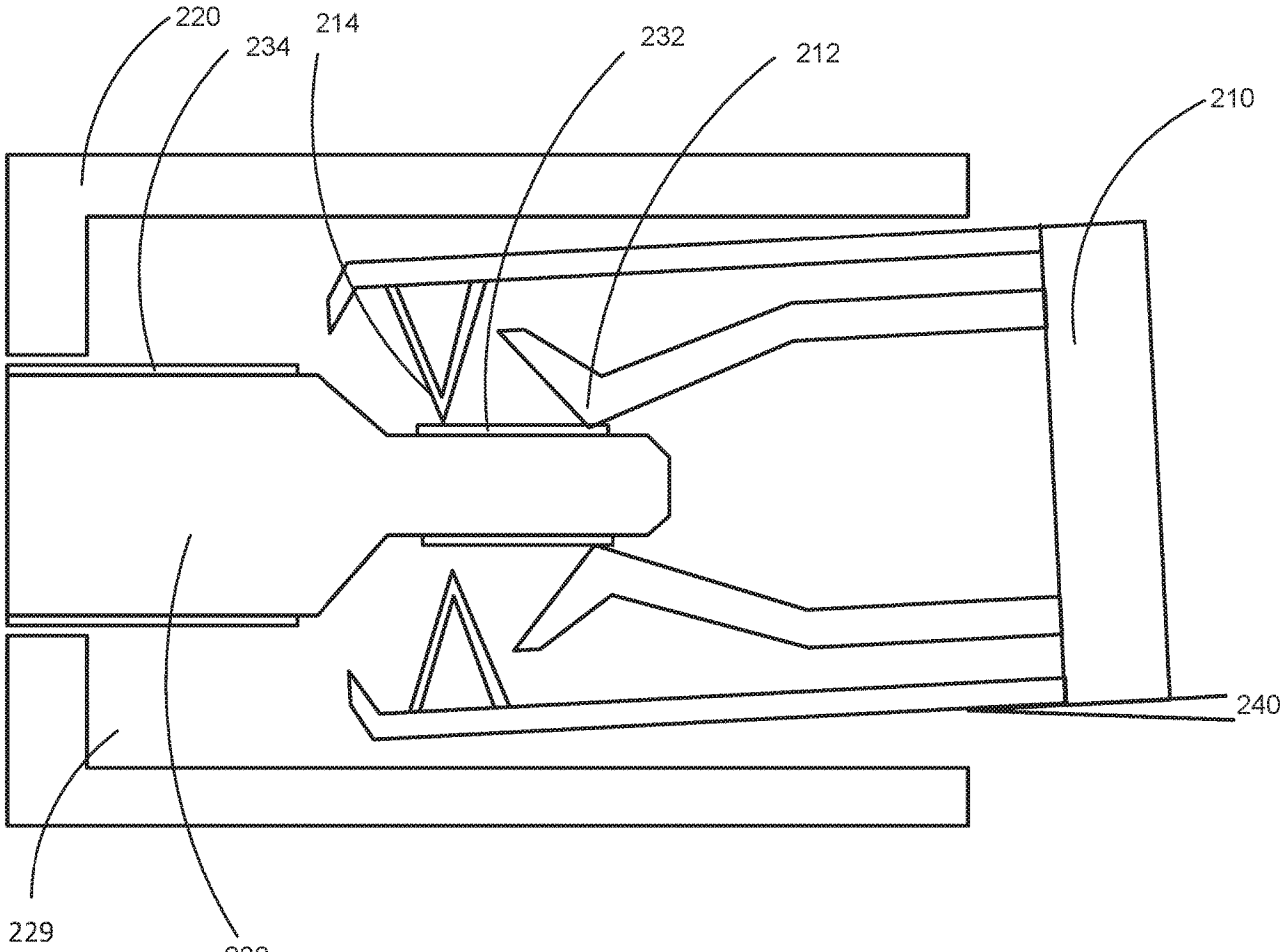
FIGURE 2 (PRIOR ART)
FIG. 2 illustrates a cutaway side view of a connector insert being extracted from a connector receptacle according to an embodiment of the present invention.

FIG. 2 illustrates a cutaway side view of a connector insert being extracted from a connector receptacle according to an embodiment of the present invention. This figure includes connector insert 210 having a number of signal, ground, and VBUS power contacts 212, and EMI ground contacts 214. This figure also includes a connector receptacle including tongue 230 located in an opening in device enclosure 220. A number of signal, ground, and VBUS power contacts 232 may be formed on tongue 230. Tongue 230 may further include EMI ground contacts 234.

When connector insert 210 is fully inserted into passage 229 of the connector receptacle, EMI ground contacts 214 on connector insert 210 may mate with EMI ground contact 234 on tongue 230. Similarly, signal, ground, and VBUS power contacts 212 may be in contact and electrically connected to the signal, ground, and VBUS power contacts 232 on tongue 230.

As connector insert 210 is removed, connector insert 210 may be tilted at an angle 240. This may cause EMI ground contact 214 in connector insert 210 to electrically connect to a signal contact 232 on tongue 230. Again, if a VBUS power is provided to a VBUS power pin 232 on tongue 230 while the ground contacts 234 are disconnected, current may flow from the VBUS power contact, through an ESD diode on an integrated circuits connected to tongue 230, and out of the signal pin through EMI ground contact 214 to ground. A diagram illustrating this configuration is shown in the following figure.

Figure 3:
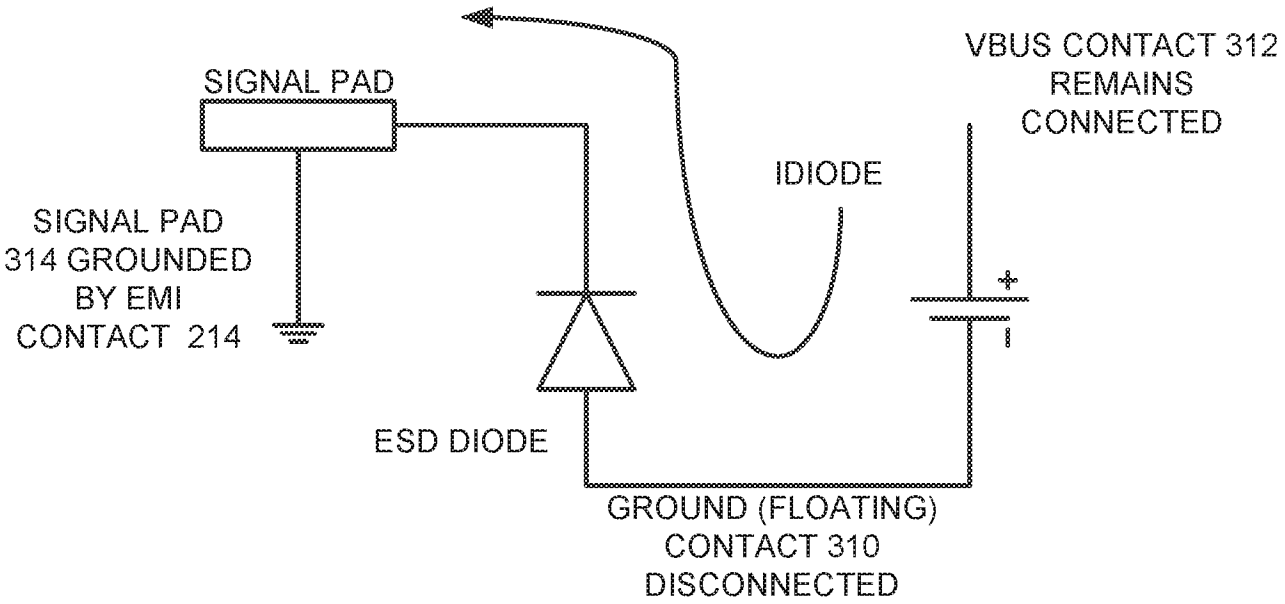
FIG. 3 is a schematic showing a transient high-current path that may be avoided by embodiments of the present invention.

FIG. 3 is a schematic showing a transient high-current path that may be avoided by embodiments of the present invention. In this example, a signal pad and ESD diode may be located on an integrated circuits connected to tongue 230. The ground of the integrated circuit may be connected to one or more of the ground contacts 310 on tongue 230. Similarly, a power supply connection VBUS may be connected to one or more of the VBUS power contacts 312 on tongue 230. Again, VBUS power contacts and ground contacts may nominally be placed at a similar distance from a front edge of a connector receptacle tongue. However, variations in the positions of these contacts, the length of these contacts, or other parameters regarding these contacts, may result in a VBUS contact remaining electrically connected to a corresponding contact in the connector inserts after the ground contacts have been disconnected from their corresponding contacts. This may result in a VBUS power supply being provided to the integrated circuit connected to or associated with tongue 230. The ground of the integrated circuit may be floating. Specifically, one or more of the VBUS power contacts 312 may be connected to a power supply, while each of the ground contacts 310 may be disconnected. At this same time, one or more EMI contacts 214 in connector insert 210 may come in contact with one or more signal pads 314. This configuration may provide a path for a current that flows from a VBUS power contact 312, through an ESD diode associated with a signal pad on the integrated circuit, and to ground through EMI contacts 214. This current may be sufficiently high as to short or otherwise damage the ESD diode or other circuitry on the integrated circuit.

Again, to reduce or eliminate the chances of this configuration occurring, one or more contacts on a connector receptacle tongue may be modified in a manner consistent with an embodiment of the present invention. An example of a connector receptacle tongue that may be improved by an embodiment of the present invention is shown in the following figure.

Figure 4:
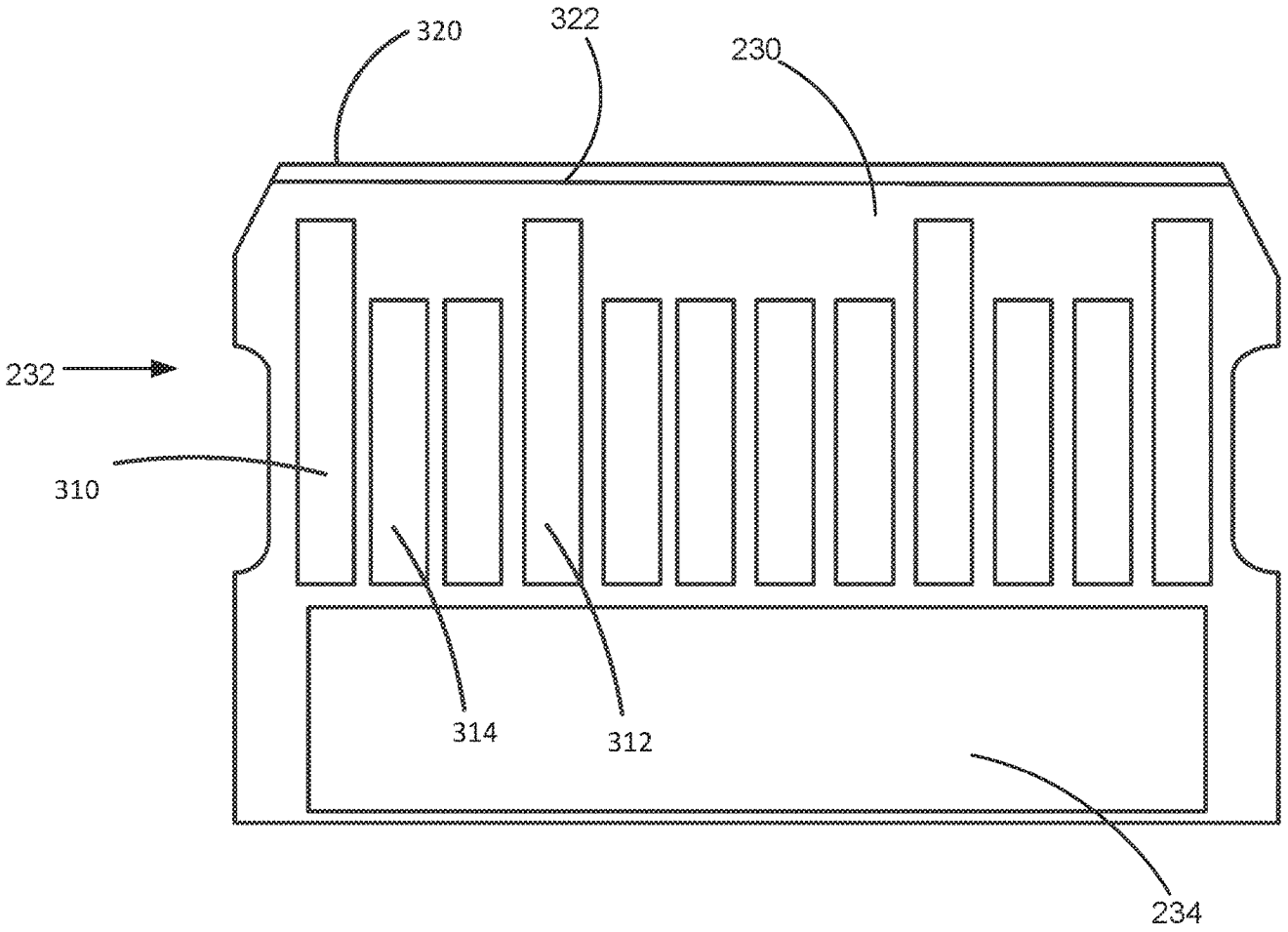
FIG. 4 illustrates a connector receptacle tongue that may be improved by the incorporation of an embodiment of the present invention.

FIG. 4 illustrates a connector receptacle tongue that may be improved by the incorporation of an embodiment of the present invention. Tongue 230 may support a number of signal, ground, and VBUS contacts 232. Specifically, tongue 230 may support signal contacts 314, ground contacts 310, and VBUS power contacts 312. Tongue 230 may also support EMI ground contacts 234. Tongue 230 may include a leading edge 320 having a chamfered edge 322. These features may each be repeated on a bottom side of tongue 230.

Figure 5:
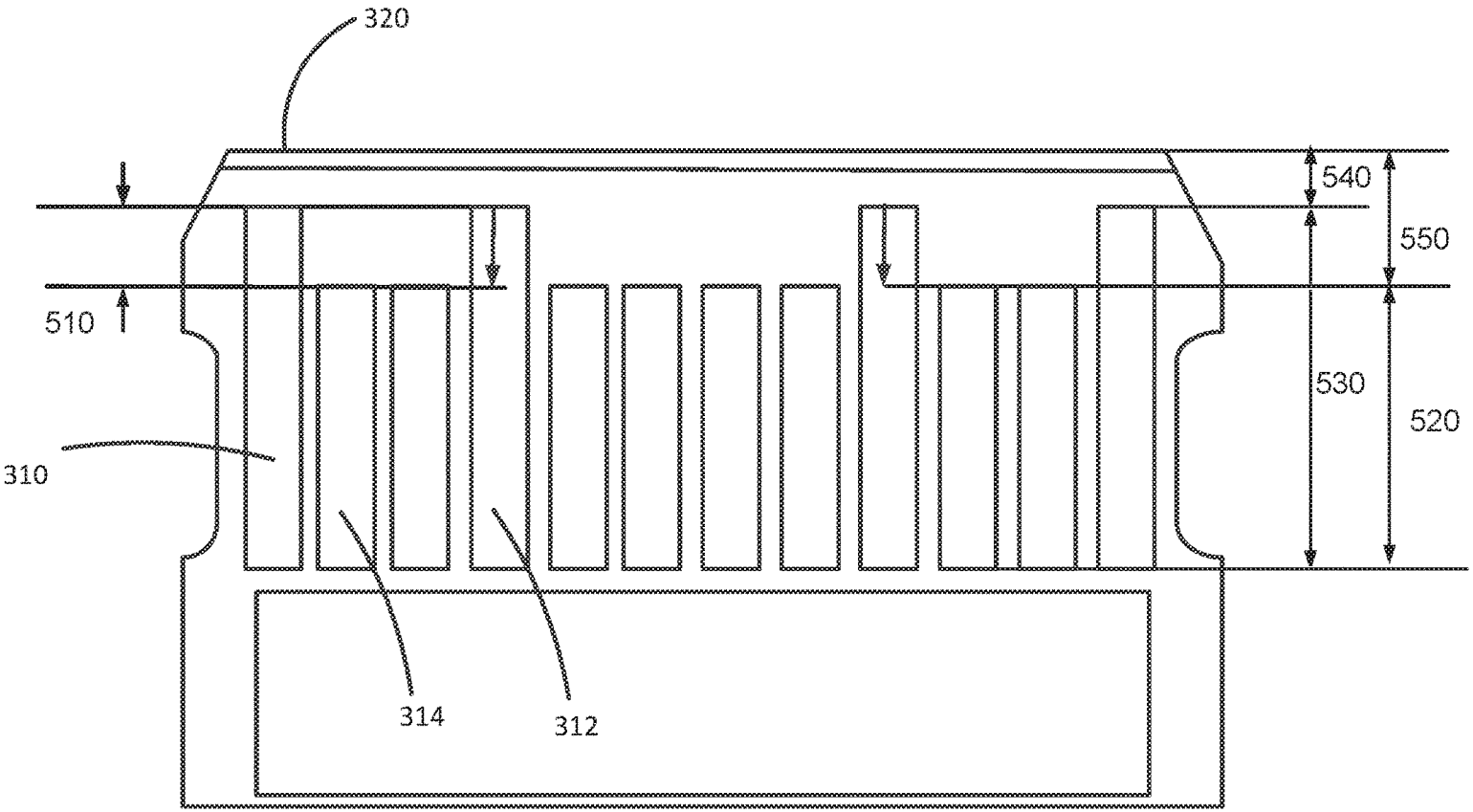
FIG. 5 illustrates a connector receptacle tongue according to an embodiment of the present invention.

FIG. 5 illustrates a connector receptacle tongue according to an embodiment of the present invention. Again, the VBUS power contacts 312 and ground contacts 310 may be located nominally the same distance 540 from a front edge 320 of the tongue. Again, due to variations in printing, plating, or other manufacturing step, the contact positions or length may vary such that may at least one VBUS power contact 312 may be closer to a front edge 320 than the ground contacts 310. This may mean that during a disconnection of a connector insert, VBUS power may be provided to the VBUS power contact 312 by a corresponding insert contact after the ground contacts 310 have been disconnected from their corresponding connector insert contacts. In order to prevent this occurrence, embodiments of the present invention may shorten one or more of the VBUS power contacts 312 a distance 510. More specifically, an edge of one or more VBUS power contacts 312 may be pulled back a distance 510 from a front edge 320 on the tongue. In a specific embodiment of the present invention, the distance 510 may be 0.5 mm, though this distance may vary in a manner consistent with an embodiment of the present invention. On a tongue with a modified VBUS power contacts 312, the signal contacts 314 and VBUS power contacts 312 may have a length 520 and maybe spaced a distance 550 from a front edge 320 of the tongue. Ground contacts 310 may have a length of at least 530 and may be spaced a distance 540 from a front edge 320 of the tongue. In this example, distance 540 is shorter than distance 550 by 0.5 mm.

In this example, while the signal contacts 314 and VBUS power contacts 312 may nominally have the same length, due to variations in plating or printing, the positions or lengths of these contacts may vary and be different. In some circumstances, at least one of the signal contacts 314 may be longer than the VBUS power contacts 312. When this happens, and a high input voltage is provided to the signal contact 314 after each of the VBUS power contacts 312 have been disconnected, an integrated circuit input structure connected to signal contact 314 may become damaged. To prevent this, embodiments of the present invention may provide a high capacitance at VBUS such that the power supply is maintained on the integrated circuit during a disconnect. These and other embodiments of the present invention may provide an integrated circuit that is high-voltage tolerant. These and other embodiments of the present invention may provide AC coupling to signal pins to avoid direct application of DC voltages to signal pins. These and other embodiments of the present invention may provide a connector receptacle tongue where the signal contacts 314 remain further away from edge 320 than at least one of the VBUS power contacts 312. An example is shown in the following figure.

Figure 6:
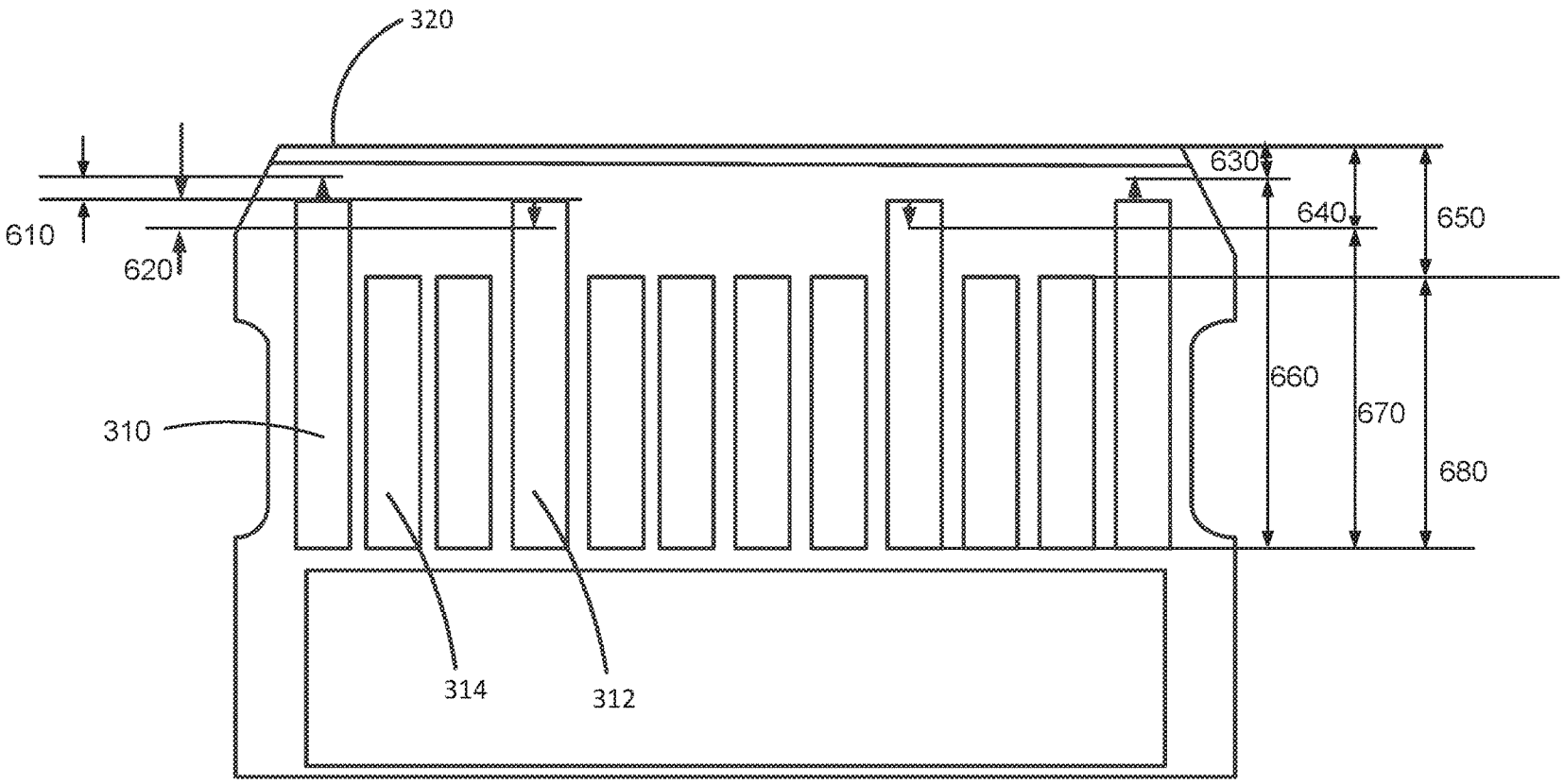
FIG. 6 illustrates another connector receptacle tongue according to an embodiment of the present invention.

FIG. 6 illustrates another connector receptacle tongue according to an embodiment of the present invention. In this example, VBUS power contacts 312 are again pulled back from edge 320 of the connector receptacle. However, to avoid a situation where a high voltage is received at an input structure of an integrated circuit while its VBUS power supply has been removed, the VBUS power contacts 312 remain longer than the signal contacts 314. The result of this may be that VBUS power contacts 312 remain similar in length to the ground contacts 310. Accordingly, this embodiment of the present invention may lengthen the ground contacts 310. That is, an edge of the ground contacts 310 may be moved closer to a front edge 320 of the tongue. In this example, an edge of ground contacts 310 may be moved a distance 610 towards a front edge 320 of the tongue. This distance 610 may be 0.1 mm or other distance. For example, one or more ground contacts 310 may be extended such that they reach the front edge 320 of the tongue. Also, one or more of the VBUS power contacts 312 may be moved a distance 620 away from front edge 320 of the tongue. This distance 620 may be 0.25 mm or other distance. In this configuration, ground contacts 310 may be a distance 630 from a front edge 320, VBUS power contacts 312 may be a distance 640 from front edge 320, and signal contacts may be a distance 650 from front edge 320. That is, ground contacts 310 may be closest to edge 320, followed by VBUS power contacts 312, while signal contacts 314 may be the furthest removed from front edge 320. The result may be that the ground contacts 310 have a length of at least 660, VBUS power contacts 312 have a length 670, while the signal contacts have a length 680. That is, ground contacts 310 may be the longest, followed by VBUS power contacts 312, while the signal contacts 314 may be the shortest of the three.

Variations in the position and length of these contacts is anticipated by the present USB Type-C specification. Accordingly, the lengths of these contacts have a permissible tolerance associated with them. This tolerance may be more than is needed to account for an actual manufacturing process. Accordingly, the nominal lengths or positions of these contacts may be varied in a manner consistent with the present USB Type-C specification. Accordingly, an embodiment of the present invention may modify lengths of these contacts in this manner to avoid the undesirable transient situations shown above. An example is shown in the following figure.

Figure 7:
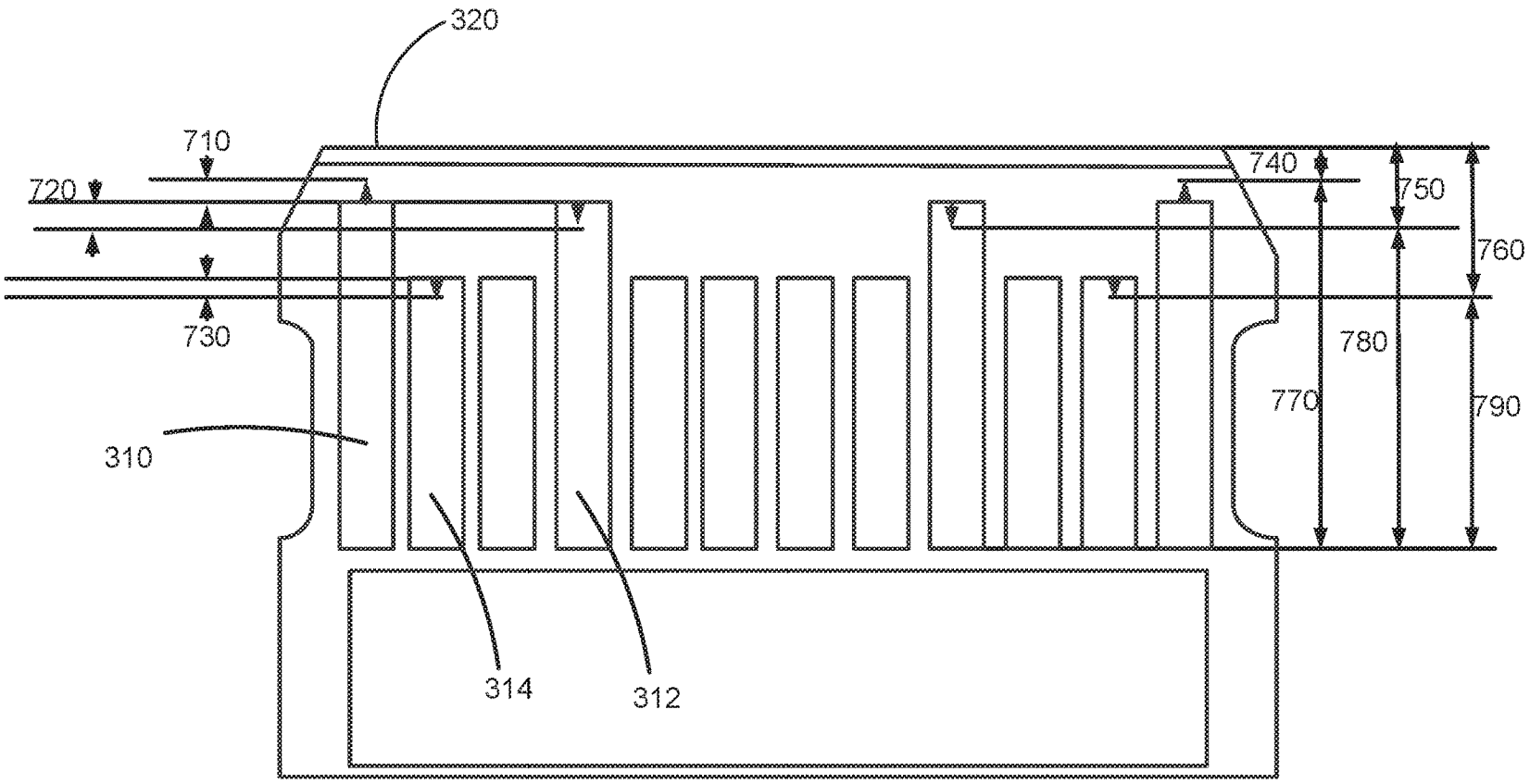
FIG. 7 illustrates another connector receptacle tongue according to an embodiment of the present invention.

FIG. 7 illustrates another connector receptacle tongue according to an embodiment of the present invention. In this example, ground contacts 310 may be lengthened a distance 710 such that an edge of at least one ground contact 310 may be moved closer to a front edge 320 of the tongue. To avoid the input integrated circuit from receiving VBUS power after its ground is been removed, one or more VBUS power contacts may be shortened a distance 720 such that an edge is moved further away from a front edge 320 of the connector receptacle tongue. To prevent a situation where an input signal structure on the input integrated circuit receives a high voltage after its power supply has been removed, one or more of the signal contacts 314 may also be moved away a distance 730 from a front edge 320.

In this specific example, the ground contacts 310 may be moved by 0.1 mm when a solder mask is located in the area between ground contacts 310 and front edge 320. This relatively small change in length may ensure that the solder mask in this area sufficiently thick or wide to withstand abrasive forces from corresponding ground contacts in a connector insert during insertion and extraction. In other embodiments of the present invention, the solder mask may be removed or otherwise omitted, thereby allowing one or more of the ground contacts to have an edge closer, for example by 0.2 mm, to front edge 320. While the tongue area without of the solder mask may be considerably more abrasive, the relatively short distance between the ground contacts 310 and front edge 320 may reduce wear on the corresponding ground contacts in the connector insert that may otherwise occur. Also, one or more VBUS contacts may be shortened or moved away from front edge 320 by 0.1 mm or other distance. One or more signal contacts may be shortened or moved away from front edge 320 by 0.05 mm or other distance.

With these modifications, one or more of the ground contacts 310 may be a distance 740 from front edge 320, one or more of the VBUS power contacts 312 may be a distance 750 from front edge 320, while one or more signal contacts 314 may be distance 760 from a front edge 320. The result of this may be that ground contacts 310 may be closest to front edge 320, followed by VBUS power contacts 312, while the signal contacts 340 may be furthest away from front edge 320. The length of the ground contacts 310 may be the longest at length 770, followed by VBUS power contacts 312 at length 780, while the signal contacts 314 at length 790 may be the shortest.

As shown in FIG. 2, a connector receptacle may include a tongue in a housing. In this configuration, the receptacle might not include a shield around the tongue. Accordingly, when a connector insert is inserted into the connector receptacle, there might not be an electrical connection to an outside of a shield around the connector insert. Accordingly, embodiments of the present invention may provide a connector receptacle having contacts to form a ground connection with a connector insert shield. An example is shown in the following figure.

Figure 8:
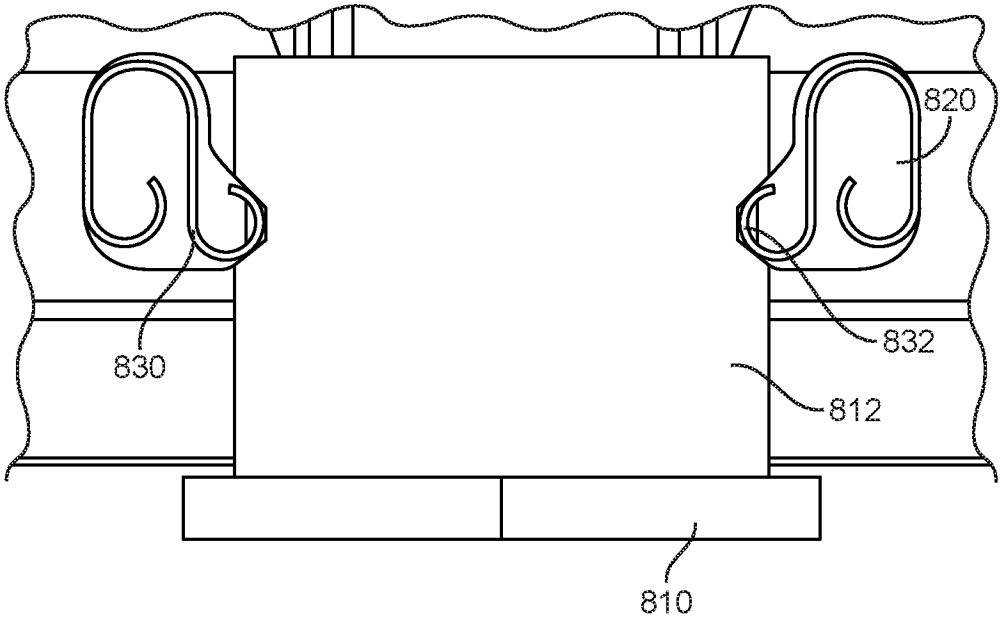
FIG. 8 illustrates ground contacts that may be included in a connector receptacle according to an embodiment of the present invention.

FIG. 8 illustrates ground contacts that may be included in a connector receptacle according to an embodiment of the present invention. In this example, a connector insert 810 having a shield 812 is inserted into the connector receptacle. Ground spring contacts 830 may be located in openings 820 in the device enclosure, which may be located on opposite sides of tongue 230 in passage 229 (shown in FIG. 2.) Ground spring contacts 830 may be electrically grounded and may come in contact with shield 812 at contact points 832. This ground path may ensure that the ground on an integrated circuit connected to a tongue in a connector receptacle remains grounded during a connector insert disconnect, thereby preventing the transient high-current configuration shown in FIG. 3 above.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a device enclosure substantially housing the electronic device; and a Universal Serial Bus Type-C connector receptacle comprising:

a passage in the device enclosure;

a connector receptacle tongue located in the passage in the device enclosure;

a plurality of contacts formed on a top side and a bottom side of the tongue;

a first side opening in the device enclosure, the first side opening in a first side of the passage in the device enclosure;

a second side opening in the device enclosure, the second side opening in a second side of the passage in the device enclosure;

a first ground spring contact located in the first side opening; and a second ground spring contact located in the second side opening.

2. The electronic device of claim 1 wherein the first ground spring contact and the second ground spring contact each comprise a first open-tube portion.

3. The electronic device of claim 2 wherein when a connector insert is extracted from the connector receptacle, the first ground spring contact electrically connects to a shield of the connector insert after a ground contact of the connector insert electrically disconnects from a signal contact on the connector receptacle tongue.

4. The electronic device of claim 2 wherein the first ground spring contact and the second ground spring contact each further comprise a second open-tube portion joined to the first open-tube portion by a U-shaped portion.

5. The electronic device of claim 4 wherein a section of the first open-tube portion of the first ground spring contact extends into the passage in the device enclosure and a section of the first open-tube portion of the second ground spring contact extends into the passage in the device enclosure.

6. The electronic device of claim 5 wherein when a connector insert is mated with the connector receptacle, the first ground spring contact and the second ground spring contact physically and electrically connect to a shield of the connector insert.

7. The electronic device of claim 1 wherein when a connector insert is mated with the connector receptacle, the first ground spring contact and the second ground spring contact electrically connect to a shield of the connector insert.

8. The electronic device of claim 1 wherein the first ground spring contact and the second ground spring contact are electrically connected to ground in the electronic device.

9. The electronic device of claim 8 further comprising an integrated circuit coupled to a signal contact on the connector receptacle tongue.

10. The electronic device of claim 9 wherein the electronic device is a portable computer.

11. An electronic device comprising:

a device enclosure substantially housing the electronic device; and a Universal Serial Bus Type-C connector receptacle comprising:

a passage in the device enclosure;

a connector receptacle tongue located in the passage in the device enclosure;

a plurality of contacts formed on a top side and a bottom side of the tongue;

a side opening in the device enclosure, the side opening in a side of the passage in the device enclosure; and a ground spring contact located in the side opening.

12. The electronic device of claim 11 wherein the ground spring contact comprises a first open-tube portion.

13. The electronic device of claim 12 wherein when a connector insert is extracted from the connector receptacle, the ground spring contact electrically connects to a shield of the connector insert after a ground contact of the connector insert electrically disconnects from a signal contact on the connector receptacle tongue.

14. The electronic device of claim 12 wherein the ground spring contact further comprises a second open-tube portion joined to the first open-tube portion by a U-shaped portion.

15. The electronic device of claim 14 wherein a section of the first open-tube portion of the ground spring contact extends into the passage of the device enclosure.

16. The electronic device of claim 15 wherein when a connector insert is mated with the connector receptacle, the ground spring contact physically and electrically connects to a shield of the connector insert.

17. The electronic device of claim 11 wherein when a connector insert is mated with the connector receptacle, the ground spring contact electrically connects to a shield of the connector insert.

18. The electronic device of claim 11 wherein the ground spring contact is electrically connected to ground in the electronic device.

19. The electronic device of claim 18 further comprising an integrated circuit coupled to a signal contact on the connector receptacle tongue.

20. The electronic device of claim 19 wherein the electronic device is a portable computer.

* * * * *